United States Patent [19]

Anderson et al.

[11] Patent Number: 4,831,652

[45] Date of Patent: May 16, 1989

[54] STEREO EXPANSION CIRCUIT SELECTION SWITCH

[75] Inventors: Mark R. Anderson; Robert E. Morris, Jr., both of Indianapolis, Ind.

[73] Assignee: Thomson Consumer Electronics, Inc., Princeton, N.J.

[21] Appl. No.: 190,438

[22] Filed: May 5, 1988

[51] Int. Cl.[4] ..... H04S 1/00

[52] U.S. Cl. ..... 381/1

[58] Field of Search ..... 381/1, 27, 17, 28

[56] References Cited

U.S. PATENT DOCUMENTS 3,417,203 12/1968 Hafler ..... 381/27

4,495,637 1/1985 Bruney ..... 381/1

OTHER PUBLICATIONS

Lancaster, CMOS Cookbook, 1979, pp. 349–355.

*Primary Examiner*—Forester W. Isen

*Attorney, Agent, or Firm*—E. M. Whitacre; P. M. Emanuel; L. L. Hallacher

[57] ABSTRACT

A stereo expansion circuit selection switch includes a transmission gate to cross couple the right and left channels as needed for stereo expansion.

14 Claims, 1 Drawing Sheet

STEREO EXPANSION CIRCUIT SELECTION SWITCH

BACKGROUND

This invention is directed to a switching device for selectively actuating or deactuating the stereo expansion circuit of an audio system.

Stereo expansion in audio systems is well known in the art and has been available for many years. In such systems, the right and left channel signals are processed in a manner which makes it appear to the listener that the separation of the speakers is much greater than the actual physical separation. In the prior art, stereophonic systems having expansion capability typically include a relatively complex electronic switching arrangement which enables the incoming signals to be input either directly to the audio processing system when expansion is not utilized or through a stereo expansion circuit when expansion is utilized. This selection circuitry and switching circuitry therefore substantially adds to the complexity and cost of the stereo receiver. Another difficulty with the prior art expansion system arises because the expansion circuitry changes the impedance from the incoming circuitry. For this reason, impedance matching devices must be added to the expansion circuitry in order to optimize the operation of the processing circuitry.

FIG. 1 is a simplified block diagram showing the selection of expanded stero in a prior art system. The right (R) and left (L) audio signals are received on input lines 1 and 1a respectively. A selection switch 2 is shown as a double-pole double-throw switch for purposes of illustration, in an actual stereo receiver the switch 2 is an electronic switch, many types of which are available. When expanded stereo is not desired the switch is coupled to lines 1 and 1*a* and the R and L signals pass directly through the switch 3 to output lines 8 and 9. The input lines 1 and 1*a* are also coupled to a stereo expansion circuit 3 having output lines 5 and 5*a*. The expansion circuit 3 processes the R and L audio signals in known manner and the expanded audio signals L+X(L—R) and R+X(R—L) are available on output lines 4 and 5 of the expansion circuit 3. An impedance matching circuit 6 is arranged between the expansion circuit 3 and the switch 2. The impedance matching circuit is used to match the impedance of the expansion circuit 3 to that of the subsequent circuitry. When stereo expansion is desired the switch 2 is connected to the output lines 7 and 7a of the impedance matching circuit 6 and the L+X(L—R) and R+X(R—L) signals are available on the output lines 8 and 9 respectively of the switch 2. Accordingly, in the prior art the impedance matching circuit 6 and the switch 2 are needed to provide for selective stereo expansion capability. In highly competitive markets, such as consumer electronic markets including stereophonic color television receivers, savings in cost and complexity are of paramount importance. For these reasons there is a need for a simple, inexpensive but effective stereo expansion circuit selection switch. The present invention fulfills these needs.

SUMMARY

A stereo expansion circuit has right and left amplifying channels with the right and left channels each having a first input terminal for providing unexpanded stereo signals. Each of said channels also has a second input terminal. A selection device comprises switch means cross coupling the second input terminals for providing expanded stereo when the switch means is closed.

DETAILED DESCRIPTION

Figure 1:
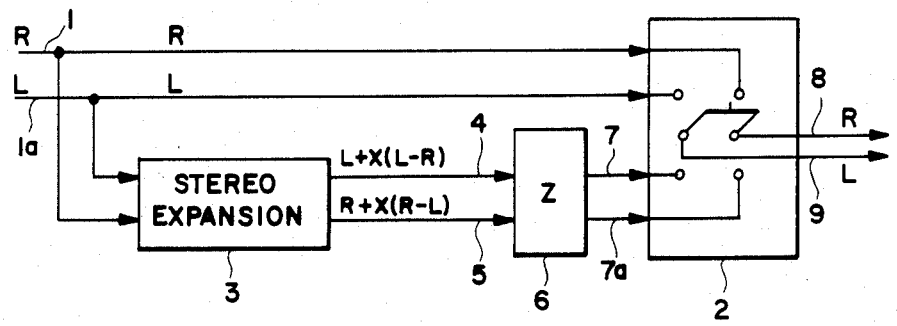
FIG. 1 PRIOR ART
FIG. 1 is a simplified diagram showing a prior art stereo expansion selection system.
Figure 2:
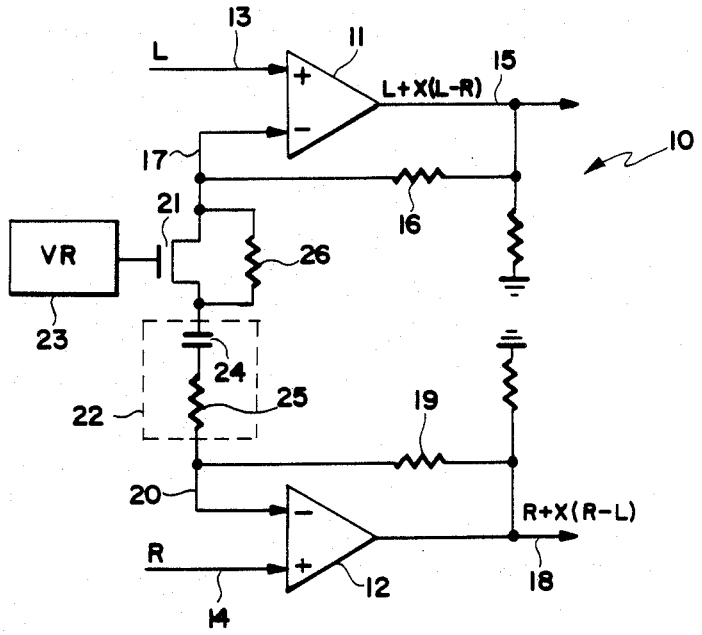
FIG. 2 is a simplified diagram of a stereo expansion circuit incorporating the preferred embodiment.

In FIG. 2, a stereo expansion circuit 10 includes two operational amplifiers (op amp) 11 and 12. A left (L) channel signal is applied to the positive (non-inverting) input terminal of the op amp 11 by way of an input line 13. A right (R) channel signal is applied to the positive input terminal of the op amp 12 by an input line 14. The output line 15 of the op amp 11 is fed back to the negative (inverting) input terminal of the op amp 11 through a resistor 16 and an input line 17. The right channel signal available on the output line 18 of the op amp 12 if fed back to the negative input terminal of the op amp through a feedback resistor 19 and a line 20. The negative input lines 17 and 20 of the op amps 11 and 12, respectively, are connected through a transmission gate 21, preferably an FET, and a filter 22. The gate control electrode of the transmission gate 21 is actuated by a control voltage source 23. The value of the control voltage from the source 23 is selected on the basis of the characteristic of the transmission gate 21 and the bias of line 17, to enable the transmission gate 21 to be fully turned "on" (conductive) or "off" (nonconductive).

In operation, when stereo expansion is not utilized in the receiver, the output of the voltage responsive device 23 is low and transmission gate 21 is nonconductive. The input lead 13 of the OP amp 11 receives the left channel (L) signal. The audio signal is amplified by the amplifier 11 and applied to the output line 15 as a pure left channel signal. Similarly, the input line 14 of the OP amp 12 receives the pure R signal to apply an amplified pure right channel (R) signal to the output line 18. Accordingly, the stereo signals pass directly through the amplifiers 11 and 12 to the demodulating and other circuitry of the stereo system.

When stereo expansion is to be utilized in the system, the voltage responsive device 23 receives a positive input, which the listener initiates by a selection key available on the receiver, to render the transmission gate 21 conductive. When the transmission gate 21 is conductive the negative input lines 17 and 20 of the op amps 11 and 12 are coupled through the filter 22. The right and left channel signals are fed back by the resistors 16 and 19 and the differential cross channel coupling causes each channel output to affect the output of the other channel. Accordingly, the output signal on the output line 15 of the op amp 11 is a L+X(L—R) signal while the output signal on the output line 18 of the op amp 12 is a R+X(R—L) signal, as is required for stereo expansion. The coefficient X is determined by the characteristics of the filter 22, and typically is less than unity. When the input signal is monaural, the R and L signals are equal and are present on the output lines 15 and 18 respectively.

The filter 22 includes a capacitor 24 and a resistor 25. The exact values for the capacitor 24 and resistor 24 are dependent upon the amount of cross coupling desired. As the coupling coefficient increases the apparent separation of the speakers also increases. The parameters of resistor 25 and capacitor 24 establish the cross coupling of filter 22. As the value of resistor 25 increases the cross coupling decreases because the current flow decreases. Capacitor 24 determines the frequencies at which coupling occurs. The value of capacitor 24 is selected to cause very little coupling at low frequencies, as the frequency increases to about 150 Hz or 200 Hz coupling begins and is full at about 1 KHz to 3 KHz, and then begins to decrease and is virtually zero at 5 KHz.

A high impedance means 26, such as a resistor having a high resistance, such as 10 megaohms, is shunted across the drain-source electrodes of transmission gate 21. The high impedance 26 is used to prevent audible "pops" or switching transients from being generated when the transmission gate 21 is turned on and off, and the impedance is sufficiently high to prevent cross channel coupling when the transmission gate 21 is non-conductive.

What is claimed is:

1. In a stereo expansion circuit having a right amplifying channel and a left amplifying channel, said right and left channels each having a first input terminal for receiving a stereo signal component, each of said channels also having a second input terminal for receiving a stereo signal component, a selection device comprising;

transmission gate switching means including a transmission gate coupling said second input terminals for providing expanded stereo when said switching means is closed and nonexpanded audio when said switching means is open;

control voltage means for actuating said transmission gate;

high impedance means shunting said transmission gate for preventing audible switching transients; and filter means in series with said transmission gate.

2. The selection device of claim 1 wherein said high impedance means is a resistor.

3. In a stereo expansion circuit having a right amplifying channel and a left amplifying channel, said right and left channels each having a non-inverting input terminal for receiving a stereo signal component, each of said channels also having an inverting input terminal for receiving a stereo signal component, a selection device comprising;

transmission gate switching means coupling said inverting input terminals for providing expanded stereo when said switching means is closed and nonexpanded audio when said switching means is open;

filter means arranged between said switching means and one of said amplifying channels.

4. The selection device of claim 3 wherein said filter means is an R-C filter.

5. The selection device of claim 4 wherein said filter means is a series R-C filter.

6. In a stereo expansion circuit having right and left channels, each channel including amplifier means having an output terminal and a non-inverting input terminal for receiving stereo signals, and an inverting input terminal for receiving feedback signals from the respective output terminals, an improvement comprising:

switch means cross coupling said inverting input terminals for providing expanded stereo when said switch means is closed and nonexpanded stereo when said switch means is open.

7. The improvement of claim 6 wherein said amplifier means are operational amplifiers.

8. The improvement of claim 7 wherein said switch means is a transmission gate.

9. The improvement of claim 8 further including filter means arranged between said transmission gate and said amplifiers.

10. The improvement of claim 9 wherein said filter means is a series R-C filter.

11. The improvement of claim 10 further including high impedance shunting said transmission gate.

12. The improvement of claim 11 wherein said high impedance means is a resistor.

13. The improvement of claim 8 further including high impedance means shunting said transmission gate.

14. The improvement of claim 13 wherein said high impedance means is a resistor.

* * * * *